United States Patent [19]

Moulin

[11] Patent Number: 4,521,124

[45] Date of Patent: Jun. 4, 1985

[54] CHARACTERS CARRYING PRINT WHEEL DISC FOR PRINTING MACHINE AND METHOD OF MANUFACTURING SAME

[75] Inventor: Blaise Moulin, Corcelles, Switzerland

[73] Assignee: Caracteres S.A., Neuchatel, Switzerland

[21] Appl. No.: 551,304

[22] Filed: Nov. 14, 1983

[30] Foreign Application Priority Data

Nov. 15, 1982 [CH] Switzerland ..... 6638/82

[51] Int. Cl.[3] ..... B41J 1/04

[52] U.S. Cl. ..... 400/144.2; 400/174; 400/175

[58] Field of Search ..... 400/144.2, 144.1, 144, 400/140, 139, 174, 175

[56] References Cited

U.S. PATENT DOCUMENTS

| | | | |
|---|---|---|---|
| 2,742,532 | 4/1956 | Durkee | 400/139 X |
| 3,001,628 | 9/1961 | Rice | 400/175 |
| 3,307,677 | 3/1967 | Frank et al. | 400/175 |
| 3,769,626 | 10/1973 | McClenahan | 400/174 X |
| 4,064,984 | 12/1977 | Toeppen | 400/175 |
| 4,234,262 | 11/1980 | Nakai et al. | 400/175 |

FOREIGN PATENT DOCUMENTS

| | | | |
|---|---|---|---|
| 2502546 | 10/1982 | France | 400/144.2 |
| 157761 | 9/1982 | Japan | 400/175 |
| 45060 | 3/1983 | Japan | 400/174 |

*Primary Examiner*—Edgar S. Burr
*Assistant Examiner*—James R. McDaniel
*Attorney, Agent, or Firm*—Silverman, Cass & Singer, Ltd.

[57] ABSTRACT

A hairpin type spring is mounted on the body of a print wheel disc provided with an upstanding post of generally cylindrical configuration and having an overhang and a pair of second posts spaced longitudinally from the first post. The second posts are each being provided with laterally opening facing recesses defined as ninety degree sectors, each having perpendicular lateral walls. The spring includes a bend and a pair of branch arms. The spring is mounted with its bend bearing on the post beneath the overhang and its arms within the recesses in the second posts bearing laterally against the recess walls with the free ends bearing axially against said recess walls. The first post and the upstanding second posts are formed unitary with the disc.

3 Claims, 5 Drawing Figures

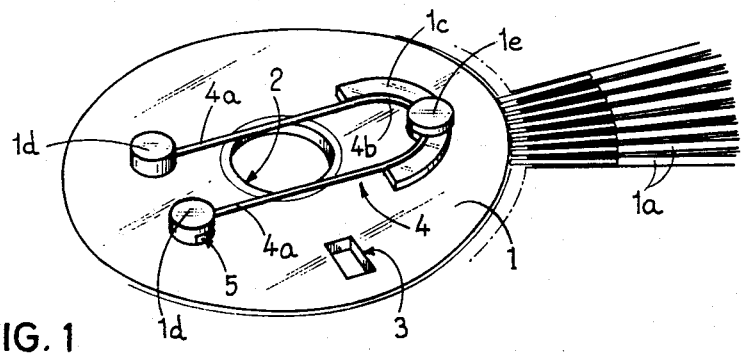
FIG. 1
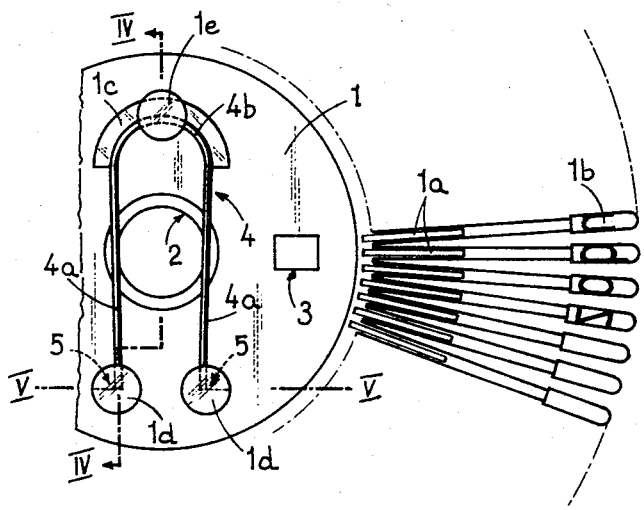
FIG. 2
FIG. 3
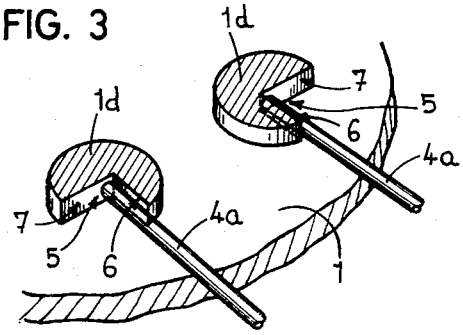
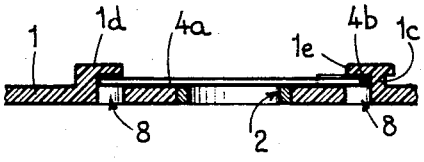
FIG. 4
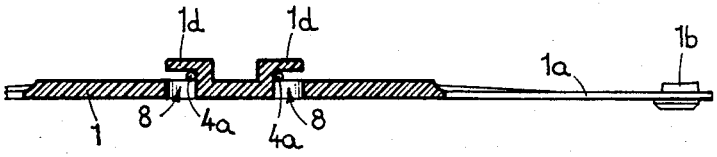
FIG. 5

CHARACTERS CARRYING PRINT WHEEL DISC FOR PRINTING MACHINE AND METHOD OF MANUFACTURING SAME

BACKGROUND OF THE INVENTION (a) Field of the Invention

The present invention relates to a printing wheel on the shaft of a printing machine by a U-shaped hairpin type wire-spring having resiliently yieldable arms and is particularly concerned with mounting of said spring on the disc; and further concerns the method of making the disc.

(b) Description of the Prior Art

A print wheel of the "daisy type" employing a U-shaped wire-spring, for mounting on the shaft of the printing machine, are known per se. The attachment of such springs on the disc body gives raise to problems including longitudinal displacement, high cost and difficulties in rapid mounting and dismounting of the spring.

SUMMARY OF THE INVENTION

The print wheel disc according to the invention is provided with means for attachment of the said hairpin type spring, said means comprising three protrusions, a first protrusion including an arcuate sector the exact shape of the bend of the spring its branches to each other, this protrusion being provided with an overlapping part extending above the said transversal portion, and a pair of additional protrusions each provided with a recess opening laterally for receiving the end of one arm of the spring. The recesses are defined by a 90° sector, one lateral wall of which is adapted to function as a lateral abutment against which the arm bears by means of its own elasticity and abutment situated opposite the end of the branch, the other wall capable of functioning as an axial abutment for the arm thereby to prevent any longitudinal displacement of the spring. The first protrusion includes an overhand, the bend of the spring being seated on the protrusion beneath the overhang.

The method of manufacture comprises the steps of engaging the bend of the spring under the overhang, bringing the bend to bear against the said protrusion to spread the spring arms and engaging the ends of the arms into the respective recesses of the additional protrusions, the arms yielding then to move towards each other under the effect of their own elasticity until they bear against the lateral wall of the said protrusions.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

BRIEF DESCRIPTION OF THE DRAWINGS

FIG. 1 is a perspective view of a portion of a characters carrying disc for a printing machine, for instance a typewriter.

FIG. 2 is a plan view of a portion of this disc.

FIG. 3 is a perspective view of a detail of this disc, to a larger scale, partially sectioned along a plane parallel to the plane of the disc.

FIG. 4 is a sectional view along line IV—IV of FIG. 2 to a larger scale, and FIG. 5 is a sectional view along line V—V of FIG. 2, also to a larger scale.

DESCRIPTION OF THE PREFERRED EMBODIMENTS

The printing disc is formed of plastic material and is designated by 1 and carries radial arms 1*a* having characters at their ends designated by 1*b*. This disc is provided with a central hole 2 permitting to be engaged on the shaft of a printing machine and also is provided with a rectangular hole 3 for receiving the driving finger of said machine (not shown).

This disc is provided with a U-shaped wire-spring 4 also known as a hairpin spring, applied against one of the faces of the body of the disc. The spring 4 has a pair of resilient arms 4*a*, which are biased towards each other. Spring 4 functions to mount the disc on the shaft of the machine, the arms 4*a* within a groove (not shown) provided in this shaft. This arrangement has not been illustrated and will not be disclosed further since it is known per se.

The spring 4 is mounted to the body of the disc by means of three protrusions formed on the disc, one of which is designated by 1*c* and the two other protrusions being designated by 1*d* These protrusions 1*c* and 1*d* are formed as one piece with the disc by moulding. The protrusion 1*c* has the configuration of an arc of a circle and is the same configuration of the bend 4*b* or transversal portion of the spring 4 connecting arms 4*a*. Protrusion 1*c* is provided with a head or overhang 1*e* which overlaps the portion 4*b* of the spring 4. Each of the two other protrusions 1*d* are provided with a recess 5, opening laterally, said respective recess 5 receiving the free end of a respective arm 4*a* of the spring 4. Recesses 5 have the shape of sectors of 90° with the lateral wall presenting two faces 6 and 7. Lateral wall 6 is parallel to the longitudinal axis of the spring 4, wall 7 being perpendicular to wall 6 as shown in FIG. 3. The arms 4*a* of the spring 4 bear resiliently against the respective faces 6, said faces constituting lateral abutments. The free ends of arms 4*a* are situated opposite the faces 7 and axially abut said faces.

The spring 4 is mounted on disc 1 by engaging the transversal portion or bend 4*b* thereof under the overhang 1*c* of the protrusion 1*c* and forcing said portion 4*b* against the protrusion 1*c*. Protrusion 1*c* has the identical arc as the bend 4*b*. The spring occupies a position whereat its plane is oblique with respect to the plane of the disc 1. While the spring is in such condition the arms 4*a* are spread and engaged each into one of the recesses 5 formed in the protrusions 1*d*. The spring 4 is then applied against the body of the disc 1 and the arms 4*a* released. These arms 4*a* are biased to move towards each other due to their own elasticity and also laterally abut against the faces 6 of the lateral wall of the recesses 5.

The spring 4 cannot be separated untimely from the body of the disc since it is held both by the overhang 1*c* of the protrusion 1*c* which extends above its transversal portion 4*b* and by the free protrusions 1*d* which act on the ends of the arms 4*a*. The spring is prevented from moving longitudinally parallel to the plane of the disc 1, by axially abutting against the faces 7 of the lateral wall of the recesses 5 and by the protrusion 1*c* which serves as an axial abutment for the bend portion 4*c*.

It is to be noted that the disc 1 can be provided with openings 8 situated opposite the head 1*e* of the protrusion 1*c* as well as opposite the protrusions 1*d*. The openings 8 permit the withdrawal of the disc 1 from the mould during the manufacture of the disc. They have not been represented in FIG. 3 in order to increase the clarity of the drawing.

I claim:

1. In a characters carrying print wheel disc for a printing machine of the type which includes a shaft for mounting the wheel, having means for mounting the disc on the shaft, including a U-shaped wire spring on the disc, said spring having a bend and a pair of elastically yieldable arms, each arm having a free end and being convergently biased; and means mounting the spring to the disc comprising first and second raised protrusions, said first raised protrusion comprising a first post unitary with the disc and having an overhang, said first post having an arc identical with the arc of the bend and a pair of side by side second posts longitudinally displaced from said first post and opposite thereto, said second posts each having lateral walls defining a 90 degree sector recess, said recesses opening away from each other, one wall defining an axial abutment relative to the respective spring arms and a second wall perpendicular to the one wall defining a lateral abutment relative to the spring arm, said spring disposed with its bend engaged conformingly on said first post below said overhang and its arms seated engaged within said respective recesses, the free ends bearing axially on the axial abutment while simultaneously engaged on the lateral abutment whereby longitudinal displacement of the spring is prevented.

2. Characters carrying print wheel disc as claimed in claim 1, in which said second wall is substantially parallel to the longitudinal axis of the spring.

3. Characters carrying print wheel disc as claimed in claim 1 wherein the posts are unitary with the disc.

* * * * *